United States Patent [19]

Florens

[11] 3,942,986

[45] Mar. 9, 1976

[54] PHOTOGRAPHIC ELEMENT COMPRISING A FOGGED, DIRECT-POSITIVE HETERODISPERSED SILVER HALIDE EMULSION AND A FOGGED, DIRECT-POSITIVE MONODISPERSED SILVER HALIDE

[75] Inventor: Raymond Leopold Florens, Edegem, Belgium

[73] Assignee: AGFA-GEVAERT, N.V., Mortsel, Belgium

[22] Filed: June 3, 1974

[21] Appl. No.: 476,159

[30] Foreign Application Priority Data

June 8, 1973 United Kingdom ..... 27427/73

[52] U.S. Cl. ..... 96/68; 96/101; 96/120; 96/107; 96/108

[51] Int. Cl.[2] ..... G03C 1/76; G03C 1/28

[58] Field of Search ..... 96/64, 107, 108, 101, 68, 96/120

[56] References Cited

UNITED STATES PATENTS

| | | | |
|---|---|---|---|
| 3,367,778 | 2/1968 | Berriman | 96/108 |
| 3,537,858 | 11/1970 | Wise | 96/107 |
| 3,615,573 | 10/1971 | Smith et al. | 96/68 |

FOREIGN PATENTS OR APPLICATIONS

| | | | |
|---|---|---|---|
| 723,019 | 2/1955 | United Kingdom | 96/64 |

*Primary Examiner*—Won H. Louie, Jr.
*Attorney, Agent, or Firm*—A. W. Breiner

[57] ABSTRACT

Photographic direct-positive materials are described which comprise in admixture in a single layer or in superposed layers a monodispersed direct-positive emulsion and a heterodispersed direct-positive emulsion. By the use of both types of emulsions it is possible to obtain reduced contrast and good detail rendering in the high-light areas.

8 Claims, 1 Drawing Figure

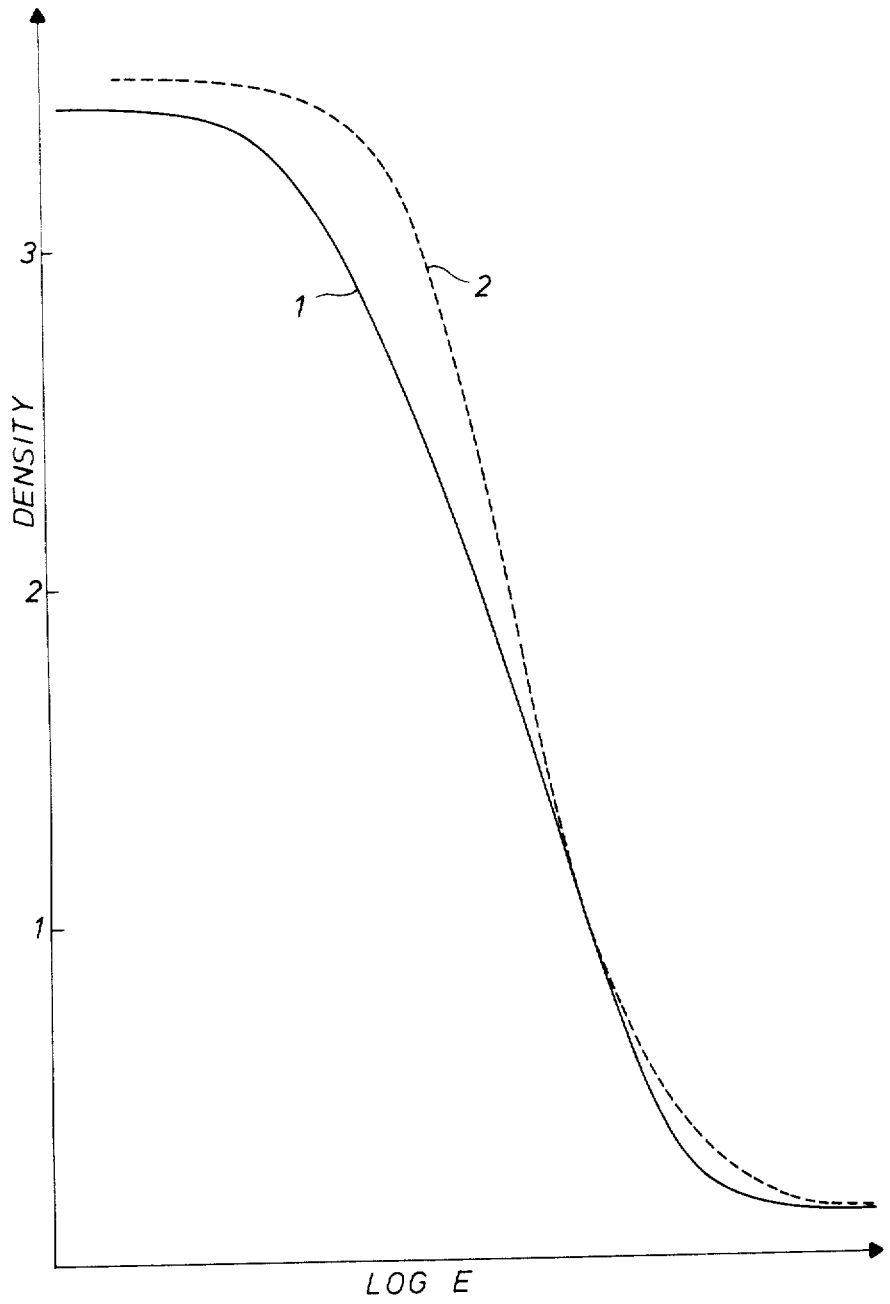
3
2
1
DENSITY
1
2
LOG E

PHOTOGRAPHIC ELEMENT COMPRISING A FOGGED, DIRECT-POSITIVE HETERODISPERSED SILVER HALIDE EMULSION AND A FOGGED, DIRECT-POSITIVE MONODISPERSED SILVER HALIDE

The present invention relates to photographic direct-positive silver halide compositions and elements.

It is known that direct-positive images can be obtained with certain types of photographic silver halide emulsions without previously forming a negative silver image. For this purpose, the silver halide grains are fogged, before or after coating on a support, by an overall exposure to actinic radiation or by overall chemically fogging e.g. by means of reducing agents or by low pAg digestion condition. Upon image-wise exposure of the prefogged emulsions the development centres formed by said fogging are destroyed at the exposed areas and remain at the unexposed areas. By subsequent conventional development by means of silver halide developers a direct-positive image is formed.

Destruction of the development centres during image-wise exposure is generally based on the Herschel effect or the solarization effect. For the first effect, exposure occurs with long wavelength light whereas for the second effect exposure occurs by means of short wavelength light. Both processes remained of little practical importance because the common silver halide emulsions have rather low speed.

Improved light-sensitivity can be obtained by proper fogging means and addition of desensitizers acting as electron traps which are adsorbed to the surface of the fogged silver halide grains. Such emulsions have been described in British Pat. No. 723,019 where fogging occurs by means of reducing agents in the presence of noble metal compounds e.g. gold compounds.

In U.S. Pat. No. 3,501,305 high speed direct-positive silver halide emulsions have been described wherein the emulsions are characterized as being monodispersed silver halide emulsions fogged by means of a reducing agent and a gold compound. These monodispersed silver halide emulsions have narrow grain-size distribution; at least about 95 percent by weight of the silver halide grains have a diameter which is within about 40 percent, preferably within about 30 percent of the mean grain diameter. Such emulsions can be prepared according to the double-jet precipitation technique by simultaneous addition of a water-soluble silver salt e.g. silver nitrate and a water-soluble halide e.g. an alkali metal halide such as potassium bromide to an aqueous solution of a silver halide peptizer e.g. gelatin. Precipitation occurs under controlled pH, pAg and temperature conditions.

Double jet precipitation techniques have been described e.g. in German Pat. No. 1,169,290.

A special type of direct-positive silver halide emulsion was introduced by E. Moisar and S. Wagner in "Berichte der Bunsengesellschaft für physikalische Chemie"67 (1963) 356–359. In these direct-positive emulsions, the sensitivity is increased by providing in the interior of the silver halide grains ripening nuclei functioning as electron traps. These so-called "covered-grain" emulsions comprising silver halide grains having a central core of silver halide provided with centres promoting the deposition of photolytic silver and an outer shell of a fogged silver halide, are prepared as described by Klein and Moisar in "Berichte der Bunsengesellschaft für physikalische Chemie" 67 (1963) 349, and in U.S. Pat. No. 3,537,858 by controlled double jet precipitation which allows proper dosing of the inner ripening nuclei. Therefore, these emulsions also show narrow grain-size distribution, and are thus monodispersed silver halide emulsions.

Monodispersed cubic and octahedral silver halide emulsions have the disadvantage of low exposure latitude and producing high contrast images so that they are only of practical importance for purposes where steep gradation is either desirable e.g. in the graphic arts, or at least not disturbing. It follows that these monodispersed direct-positive emulsions are of limited value for the reproduction of continuous-tone images where direct-positive silver halide emulsions with low gradation and high exposure latitude are desirable to obtain optimum reproduction of every tone level of the image to be reproduced.

It has been proposed to obtain reduced contrast and extended exposure latitude by combination, in a direct-positive photographic silver halide element, of monodispersed emulsions of different sensitivity e.g. emulsions of different average grain-size or emulsions selectively fogged to different fog levels, either in admixture in a single emulsion layer or coated as separate superposed emulsion layers. As is illustrated in U.S. Pat. No. 3,615,573 various distinct high contrast steps can be provided in this way on the Density vs. Log Exposure curve and good detail can be achieved in the highlight areas. However, in order to obtain a smooth extended latitude curve and thus optimum reproduction of every tone level of the image to be reproduced, a large number of emulsions of incrementally higher sensitivity should be used in a single photographic element. The preparation of multiple monodispersed emulsions of different sensitivity is relatively complicated and reproducibility in the preparation of these emulsions is insufficient so that this technique is of limited practical value.

In accordance with the present invention a direct-positive photographic element is provided which comprises in admixture in a single silver halide emulsion layer or in superposed emulsion layers a monodispersed direct-positive silver halide emulsion comprising fogged silver halide grains and a heterodispersed direct-positive silver halide emulsion comprising fogged silver halide grains.

The invention makes possible, by simple admixture of two emulsions, to provide a photographic element with reduced contrast and good detail rendering in the highlight areas, which is valuable for the reproduction of continuous tone images.

As noted above monodispersed silver halide emulsions have narrow grain-size distribution; at least 95 percent by weight of the silver halide grains have a diameter which is within about 40 percent, preferably within about 30 percent of the mean grain diameter.

These monodispersed silver halide emulsions generally have a mean grain diameter i.e. an average grain size in the range of about 0.01 to about 2 $\mu$m, preferably in the range of about 0.02 to about 1 $\mu$m.

Heterodispersed silver halide emulsions can be characterized as having wide grain-size distribution; at least 10 percent, preferably at least 20 percent by weight of the silver halide grains have a diameter which deviates by at least 40 percent from the mean grain diameter.

Heterodispersed silver halide emulsions comprise silver halide grains of widely varying grain size e.g. from 0.01 to 10 μm. The mean grain diameter i.e. average grain size is generally in the range of about 0.05 to about 2.5 μm, preferably in the range of about 0.1 to about 1 μm.

Particle size of silver halide grains can be determined using conventional methods e.g. as described by Trivelli and M. Smith, The Photographic Journal, Vol. 69, 1939, p. 330–338, Loveland, "ASTM symposium on light microscopy," 1953, p. 94–122 and Mees and Jones, "The Theory of the photographic Process," (1966), Chapter II.

As referred to hereinbefore monodispersed silver halide emulsions can be prepared by the double jet precipitation technique under controlled pH, pAg and temperature conditions. These three factors are interdependent which means that for a given temperature, the pH and pAg should be adapted to each other to obtain uniform grain size. Procedures of preparing monodispersed silver halide emulsions according to this technique are known in the art and described in the literature referred to hereinbefore.

Heterodispersed emulsions are most common in the art of silver halide photography and can be prepared according to methods generally known. According to a very simple method, an aqueous silver salt solution e.g. aqueous silver nitrate is added to an aqueous solution of hydrophilic colloid e.g. gelatin and halide(s) e.g.. alkali metal halide(s). The desired average grain size and grain-size distribution can be realized in known manner by the use of excess halide and can be modified as desired by appropriate conditions, especially time and temperature, of physical ripening.

Both the monodispersed as well as the heterodispersed direct-positive silver halide emulsions for use according to the present invention can be of the covered-grain type which means that they comprise in their interior centres promoting the deposition of photolytic silver, the said centres functioning as electron-traps.

These emulsions are known in the art and can be prepared e.g. as described in British Pat. Nos. 1,011,962, 1,027,146, 1,151,781 and 1,306,801, British Pat. application No. 15,472/70 and in German Pat. application No. 22 18 009.2.

For this purpose, a monodispersed or heterodispersed fine-grain silver halide emulsion is made first and the fine-grains serve as cores for the silver halide grains of the ultimate emulsion.

The silver halide cores thus formed are then treated so as to produce centres that promote the deposition of photolytic silver (electron traps) on the cores. The cores may be treated chemically or physically according to any of the known procedures for producing ripening nuclei i.e. latent image nucleating centres. Such procedures are described, e.g., by A. Hautot and H. Sauvenier in "Sci. et Ind. Photo," Vol. XXVIII, January 1957, p. 1–23 and 57–65.

The ripening nuclei can be formed by chemical sensitization by means of noble metal compounds, especially gold or iridium compounds, by means of sulphur compounds, e.g. thiosulphate, or by means of both noble metal compounds and sulphur compounds. Suitable compounds are e.g. alkali metal salts of the following noble metal ions : $[Au(S_2O_3)_2]^{3-}$, $[Au(SCN)_2]^-$, $[IrX_6]^{3-}$ and $[IrX_6]^{4-}$ wherein X is halogen e.g. chlorine.

Ripening of the silver halide cores can also be effected by means of reducing agents e.g. hydrazin, thiourea dioxide or tin(II)chloride, optionally together with noble metal compounds.

Electron-traps can further be provided by treating the silver halide cores with aqueous solutions of salts of polyvalent metals e.g. of the trivalent bismuth.

It is also possible to use the compounds suitable for the formation of the electron-traps, e.g. the chemical sensitizers referred to hereinbefore, during the precipitation of the fine-grain silver halide i.e. during the formation of the cores for the ultimate silver halide emulsion. In this way, the electron-traps are distributed statistically in the interior of the cores contrary to when the compounds are added after the formation of the fine-grain silver halide where the electron-traps are formed substantially at the surface of the cores. After the formation of the cores having centres promoting the deposition of photolytic silver, silver halide precipitation is continued to form around the cores an outer shell of silver halide.

According to a preferred embodiment of the present invention the monodispersed direct-positive silver halide emulsion is of the covered-grain type having in the interior of the silver halide grains centres promoting the deposition of photolytic silver whereas the heterodispersed direct-positive silver halide emulsion does not comprise such centres in the interior of the silver halide grains.

For the preparation of the direct-positive photographic element according to the present invention the monodispersed and heterodispersed silver halide emulsions can be used in admixture in a single emulsion layer or in separate superposed emulsion layers; they are preferably used in admixture in a single emulsion layer.

The silver halide grains of both direct-positive silver halide emulsions are fogged according to methods well known in the art.

The emulsions may be fogged e.g. by an overall exposure to actinic radiation or by reduction sensitization e.g. by high pH and/or low pAg silver halide precipitating or digestion conditions e.g. as described by Wood, J. Photo. Sci. 1 (1953) 1963, or by treatment with reducing agents. Fogging may also occur by reduction sensitization of the presence of a compound of a metal more electropositive than silver.

Reducing agents suitable for use include hydrazine, hydroxylamine, tin(II) compounds e.g. tin(II)chloride, tin complexes and tin chelates of the (poly)amino(-poly)carboxylic acid type as described in British Pat. No. 1,209,050, ascorbic acid, formaldehyde, thiourea dioxide, polyamines such as diethylene triamine, phosphonium salts such as tetra (hydroxymethyl)phosphonium chloride, bis(p-aminoethyl)-sulphide and its water-soluble salts, etc. Preferred reducing agents are thiourea dioxide and tin(II)chloride.

The compounds of a metal more electropositive than silver include gold compounds e.g. gold(III)chloride, potassium chloroaurate, potassium chloroaurite, and potassium aurithiocyanate, as well as compounds of rhodium, platinum, iridium, and palladium e.g. ammonium hexachloropalladate and potassium chloroiridate. Preferred noble metal compounds are gold compounds.

When fogging of the silver halide grains occurs by means of a reducing agent e.g. thiourea dioxide and a compound of a metal more electropositive than silver especially a gold compound, the reducing agent is preferably used initially and the gold compound subsequently. However, the reverse order can be used or both compounds can be used simultaneously.

The degree of fogging of the direct-positive emulsions used according to the invention may vary within a wide range. This degree of fogging depends, as is known in the art, on the concentration of the fogging agents used as well as on the pH, the pAg, the temperature and the duration of the fogging treatment. High photographic sensitivities are obtained at low degrees of fogging (see e.g. U.S. Pat. No. 3,501,307 and British Pat. application No. 7742/72). Thus, the degree of fogging can be adapted according to the requirements of desired sensitivity.

In accordance with the present invention, the emulsion characteristics such as average grain-size and fog level of both direct-positive silver halide emulsions can be selected so that both emulsions have the same or different inherent sensitivity.

The desired shape of the Density vs. Log Exposure curve can be obtained by proper combination of the fog level for each emulsion and the ratio of monodispersed to heterodispersed emulsions which can be established easily by some simple tests known to those skilled in the art. Generally, the mole ratio of heterodispersed to monodispersed silver halide per sq.m of light-sensitive element is comprised between about 0.25 and about 7.50.

The separate or mixed silver halide emulsions may comprise one or more electron-accepting or desensitizing compounds when one or both of the emulsions is(are) of the type that does not comprise in the interior of the silver halide grains electron traps in the form of centres promoting the deposition of photolytic silver. When according to a preferred embodiment of the present invention, the emulsions are used in admixture in a single layer of the photographic element, the electron-acceptor may be added to the mixture of emulsions or to one or both of the emulsions before admixture.

According to Sheppart et al, J. Phys. Chem. 50 (1946) 210, Stanienda, Z. Phys. Chem. (NF) 32 (1962) 238, and Dahne, Wiss. Phot. (1969) 161, desensitizers are dyestuffs whose cathodic polarographic half-wave potential, measured against the calomel electrode, is more positive than −1.0 V. Such-like compounds have also been described in U.S. Pat. Nos. 3,501,305, 3,501,306 and 3,501,307. The compounds described in German Pat. No. 1,153,246 and U.S. Pat. Nos. 3,314,796 and 3,615,610 are also suitable for this purpose as well as imidazo-quinoxaline dyestuffs, e.g. those described in Belgian Pat. No. 660,253.

It is known to characterize these electron-accepting or desensitizing compounds by means of their polarographic half-wave potential. Electron-acceptors suitable for use in the direct-positive silver halide emulsions of the present invention have an anodic polarographic half-wave potential and a cathodic polarographic half-wave potential that when added together give a positive sum. Methods of determining these polarographic half-wave potentials have been described, e.g., in U.S. Pat. Nos. 3,501,310 and 3,531,290.

The electron-accepting compounds preferably have spectrally sensitizing properties although it is possible to use electron-accepting compounds that do not spectrally sensitize the emulsion.

Inorganic electron-accepting compounds may also be used in the present invention, e.g. mercury(II) compounds such as mercury(II) oxide, mercury(II) chloride, mercury(II) cyanide, etc.

Use can be made of a monodispersed silver halide emulsion which comprises silver halide grains having in their interior centres promoting the deposition of photolytic silver, either in a separate layer or in admixture with the heterodisperse emulsion, and which comprises one or more so-called blue-speed increasing (BSI) or halogen-conducting compounds. These compounds can also be characterized by their polarographic half-wave potential. They preferably have an anodic polarographic half-wave potential less than 0.85 and a cathodic polarographic half-wave potential which is more negative than −1.0. More details about such compounds and examples thereof can be found in U.S. Pat. No. 3,537,858.

The silver halides employed in the preparation of the photographic emulsions useful in this invention include any of the photographic silver halides as exemplified by silver chloride, silver bromide, silver bromoiodide, silver chlorobromoiodide and the like. Emulsion blends e.g. blends of silver chloride and silver chlorobromide can be used also. In the case of a silver halide emulsions comprising grains having in their interior centres promoting the deposition of photolytic silver, the core of the grain can be composed of silver halide of different composition that that in the outer shell of the grain.

In the preparation of the direct-positive photographic silver halide emulsions for use in accordance with the present invention gelatin is preferably used as vehicle for the silver halide grains. However, the gelatin may be wholly or partly replaced by other natural hydrophilic colloids, e.g. albumin, zein, agar-agar, gum arabic, alginic acid, and derivatives thereof, such as esters, amides and salts thereof etc. or synthetic hydrophilic resins, e.g. polyvinyl alcohol and poly-N-vinyl pyrrolidone, acrylamide polymers, cellulose ethers, partially hydrolyzed cellulose acetate and the like.

In addition to the hydrophilic binding agents other synthetic binding agents can be employed in the emulsions e.g. homo- and copolymers of acrylic and methacrylic acid or derivatives thereof e.g. esters, amides and nitriles, and vinyl polymers e.g. vinyl esters and vinyl ethers.

The direct-positive silver halide emulsions for use in accordance with the present invention may comprise all kinds of known emulsion ingredients for direct-positive emulsions. They may comprise, e.g., speed-increasing compounds e.g. polyalkylene glycols and derivatives thereof, cationic surface active agents of the ammonium, sulphonium and phosphonium type, thioethers, etc. They may further comprise antifoggants and stabilizers, which include thiazolium salts, azaindenes, e.g. hydroxytetraazaindenes such as 5-methyl-7-hydroxy-s-triazolo[1,5-a]pyrimidine, mercury compounds, nitro-indazoles, nitrobenzimidazoles, heterocyclic mercapto compounds e.g. mercaptotetrazoles such as 1-phenyl-5-mercaptotetrazole, etc. The heterocyclic mercapto compounds when used in the precipitation of the silver halide for direct-positive silver halide emulsion give rise to increased maximum density and have stabilizing effect on maximum density upon storing.

Spectrally sensitizing dyes which are not electron-accepting may also be present in the emulsions, e.g. cyanines, merocyanines, complex (trinuclear) cyanines, complex (trinuclear) merocyanines, styryls and hemicyanines.

Further colour couplers may be incorporated in the direct-positive emulsions employed in the present invention. Particularly suitable are colour couplers showing a low halogenaccepting character, which can be determined by the test described by R. P. Held in Phot.-Sci.Eng. Vol. 11 (1967) p. 406. For this purpose a dispersion of silver bromide grains in buffered 0.1 N potassium bromide is illuminated and the potential is registered by means of a calomel/platinum electrode system. During illumination the platinum electrode potential rises rapidly to the redox potential of bromine. On addition of a colour coupler the potential rise can be delayed through halogen acceptance by the colour coupler. Colour couplers as well as other emulsion ingredients including binding agents for the silver halide that do not delay or do not substantially delay the potential rise are particularly suitable for use in direct positive silver halide emulsions.

The colour couplers can be incorporated into the direct-positive photographic silver halide emulsions according to any suitable technique known to those skilled in the art for incorporating colour couplers in silver halide emulsions. For example, water-soluble colour couplers, e.g. those containing one or more sulpho or carboxyl groups (in acid or salt form), can be incorporated from an aqueous solution, if necessary, in the presence of alkali, and the water-insoluble or insufficiently water-soluble colour couplers from a solution in the appropriate water-miscible or water-immiscible high-boiling (oil-former) or low-boiling organic solvents or mixtures of solvents, which solution is dispersed, if necessary in the presence of a surface-active agent, in a hydrophilic colloid composition forming or forming part of the binding agent of the silver halide emulsion; if necessary, the low-boiling solvent is removed afterwards by evaporation.

The silver halide emulsion layer(s) and any other hydrophilic colloid layer, which may be present in a direct-positive photographic material employed in accordance with the present invention, may be hardened by means of organic or inorganic hardeners commonly employed in photographic silver halide elements, e.g. the aldehydes and blocked aldehydes such as formaldehyde, dialdehydes, hydroxyaldehydes, mucochloric and mucobromic acid, acrolein, glyoxal, sulphonyl halides, vinyl-sulphones, etc.

The direct-positive photographic silver halide elements may further contain antistatic agents, wetting agents as coating aids, e.g. saponin and synthetic surface-active compounds, plasticizers, matting agents, e.g. starch, silica, polymethyl methacrylate, zinc oxide, titanium dioxide, etc., optical brightening agents including stilbene, triazine, oxazole and coumarin brightening agents, light-absorbing materials and filter dyes, mordanting agents for anionic compounds, etc.

The direct-positive silver halide emulsions can be coated in admixture as a single layer or as separate superposed emulsion layers on one or both sides of a wide variety of supports which include opaque supports, e.g. paper and metal supports as well as transparent supports, e.g. glass, cellulose nitrate film, cellulose acetate film, cellulose acetobutyrate film, polyvinylacetal film, polystyrene film, polyethylene terephthalate film, polycarbonate film and other films of resinous materials. It is also possible to employ paper coated with α-olefin polymers, e.g. paper coated with polyethylene, polypropylene, ethylene-butylene copolymers etc.

The following example illustrate the present invention.

EXAMPLE

A. Heterodispersed emulsion

A heterodispersed direct-positive silver bromoiodide emulsion (2 mole percent of iodide) comprising 95 g of silver halide per kg and having a ratio of gelatin to silver halide expressed as silver nitrate of 0.45 was prepared in a conventional way. Fogging occurred by high pH precipitation conditions and addition of a gold compound.

B. Monodispersed emulsion 75 ml of a 3N aqueous solution of potassium bromide and 75 ml of a 3N aqueous solution of silver nitrate were simultaneously introduced at a rate of 10 ml per minute into a precipitation flask containing 650 ml of a 4 percent by weight aqueous gelatin solution to which at 40°C an aqueous solution of ammonia was added in order to obtain a pH-value of 9.3. During precipitation of the silver bromide the pAg-value was adjusted to and maintained at a value corresponding to an E.M.F. of + 20 mV (Ag/saturated reference calomel electrode).

Subsequently, the internal ripening was effected. For that purpose, 3.5 ml of a $10^{-2}$ molar solution of formamidine sulphinic acid were added and the emulsion digested for 30 minutes at 40°C. Then the pH was lowered to 6.5 and 1.5 ml of an aqueous 0.08 percent by weight solution of gold(III)chloride and 1.5 ml of aqueous 2 percent by weight solution of ammonium thiocyanate were added. After said addition the digestion was continued for 10 minutes at 40°C.

The precipitation was then continued (second precipitation) as follows: an aqueous solution of ammonia was added to obtain a pH-value of 9.3 whereupon 665 ml of an aqueous 3N potassium bromide solution and 665 ml of an aqueous 3N silver nitrate solution were introduced at a rate of 19 ml per minute. During precipitation the pAg value was maintained at a value corresponding to an E.M.F. of + 20 mV (Ag/saturated calomel electrode). The emulsion was solidified after the addition of 234 g of gelatin and washed in the usual way.

After washing, the pAg was again adjusted to a value corresponding to an E.M.F. of + 20 mV (Ag/saturated calomel electrode) and the pH of the emulsion was adjusted to 6.5.

The external fogging of the composite silver bromide granules formed was then carried out for 80 minutes at 55°C with 1.25 mg of thiourea dioxide per kg emulsion, containing 115 g of silver bromide and 52 g of gelatin.

C. Photographic element I of the invention 600 g of heterodispersed emulsion A was mixed with 400 g of monodispersed emulsion B whereupon 200 mg of pinacryptol yellow and 125 mg of the following methine dye

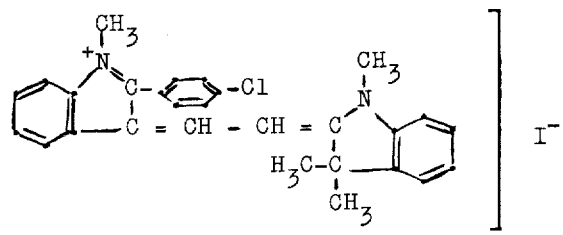

were added to the mixture.

After addition of coating aids and hardening agents, the emulsion mixture was coated on a support of polyethylene terephthalate and dried.

D. Comparative photographic element II

The heterodispersed emulsion A, after addition of 200 mg of pinacryptol yellow and 125 mg of the above methine dye per kg of emulsion, was coated on a polyethylene terephthalate support and dried.

E. Exposure, processing, results

Both elements I and II were exposed through a continuous grey wedge with constaant 0.15 by means of ordinary incandescent bulbs.

The exposed elements were processed in an automatic 90 sec processing machine. Development occurred for 23 seconds at 35°C in Agfa-Gevaert's hardening developer for automatic processing G 138 which comprises hydroquinone and 1-phenyl-3-pyrazolidinone as developing agents and glutaraldehyde as hardener.

The sensitometric results are listed in the following table. The values given for the speed measured in density 1 above fog are relative values; a value of 100 was given to the speed of the comparative element. The gradient was measured over an exposure range of $\Delta$ log It = 0.60 above and below the point of the characteristic curve corresponding to density 1 above fog.

Table

| Element | $D_{min}$ | Gradient | Speed | $D_{max}$ |
|---|---|---|---|---|
| I | 0.04 | 1.67 | 66 | 3.45 |
| II | 0.04 | 2.03 | 100 | 3.50 |

In the accompanying drawing the density versus log E curves 1 and 2 of elements I and II respectively are given which clearly show reduced overall gradation and high gamma in the toe of the curve for element I as compared with element II.

We claim:

1. A direct-positive photographic element comprising a support and coated thereon, a monodispersed direct-positive silver halide emulsion comprising surface fogged silver halide grains of which at least 95 percent by weight have a diameter which is within about 40 percent of the mean grain diameter and a heterodispersed direct-positive silver halide emulsion comprising surface fogged silver halide grains of which at least 10 percent by weight have a diameter which for at least 40 percent deviates from the mean grain diameter, said monodispersed and heterodispersed emulsions having been individually fogged.

2. A direct-positive photographic element accordint to claim 1, wherein the monodispersed and heterodispersed emulsion are present in admixture in a single silver halide emulsion layer of the element.

3. A direct-positive photographic element according to claim 2, wherein the monodispersed emulsion is an emulsion comprising silver halide grains having in their interior centres promoting the deposition of photolytic silver whereas the heterodispersed emulsion does not comprise such centres in the interior of the silver halide grains.

4. A direct-positive photographic element according to claim 1, wherein the emulsions have been individually fogged and used in a ratio whereby said element will exhibit a smooth extended Density vs. Log Exposure curve with sharp toe.

5. A direct-positive photographic element according to claim 1, wherein the mole ratio of heterodispersed to monodispersed silver halide per sq.m. of photographic element is comprised between about 0.25 and about 7.50.

6. A direct-positive photographic element according to claim 1 wherein the silver halide emulsions have been reduction and gold fogged.

7. A direct-positive photographic element according to claim 3, wherein the layer of admixed silver halide emulsions comprises an organic electron acceptor which has an anodic polarographic half-wave potential and a cathodic polarographic half-wave potential which, when added together, give a positive sum.

8. A direct-positive photographic element according to claim 7, wherein the layer of admixed emulsions also comprises a spectrally sensitizing dye.

* * * * *